United States Patent [19]

Mueller et al.

[11] Patent Number: 4,572,229

[45] Date of Patent: Feb. 25, 1986

[54] VARIABLE PROPORTIONER

[75] Inventors: Thomas D. Mueller, 666 Woodlane, Lake Forest, Ill. 60045; James D. Gessner, Chicago, both of Ill.

[73] Assignees: Thomas D. Mueller; Crown Technology Corporation, both of Lake Forest, Ill.

[21] Appl. No.: 576,413

[22] Filed: Feb. 2, 1984

[51] Int. Cl.[4] ..... F04B 35/00

[52] U.S. Cl. ..... 137/99; 417/403

[58] Field of Search ..... 137/99, 556.3; 417/399, 417/400, 403; 92/13.3, 13.7, 13.51, 129; 222/31, 134, 334; 267/179

[56] References Cited

U.S. PATENT DOCUMENTS

| | | | |
|---|---|---|---|
| 1,665,762 | 4/1928 | Waream | 267/179 |
| 2,051,307 | 8/1936 | Lorraine | 137/556.3 |
| 3,114,379 | 12/1963 | Cordis | 137/99 |
| 3,131,707 | 5/1964 | Cordis | 137/99 |
| 3,213,796 | 10/1965 | Cordis | 417/375 |
| 3,213,873 | 10/1965 | Cordis | 137/99 |
| 3,291,066 | 12/1966 | Cordis | 417/568 |
| 3,837,765 | 9/1974 | Weise et al. | 417/399 |
| 4,391,291 | 7/1983 | Hume | 137/99 |
| 4,392,508 | 7/1983 | Switall | 137/99 |

*Primary Examiner*—Alan Cohan

*Attorney, Agent, or Firm*—Hill, Van Santen, Steadman & Simpson

[57] ABSTRACT

An improved variable proportioner is provided which includes a spring biased lost motion connection between the motor piston and the slave pump piston thus providing for accurate adjustability of the metering proportion as well as prevention of stalling of the slave piston against the front cylinder wall. A pivotable connection of the toggle lever spring is also provided to reduce bending of the spring and to enhance its life span.

11 Claims, 8 Drawing Figures

FIG. 1
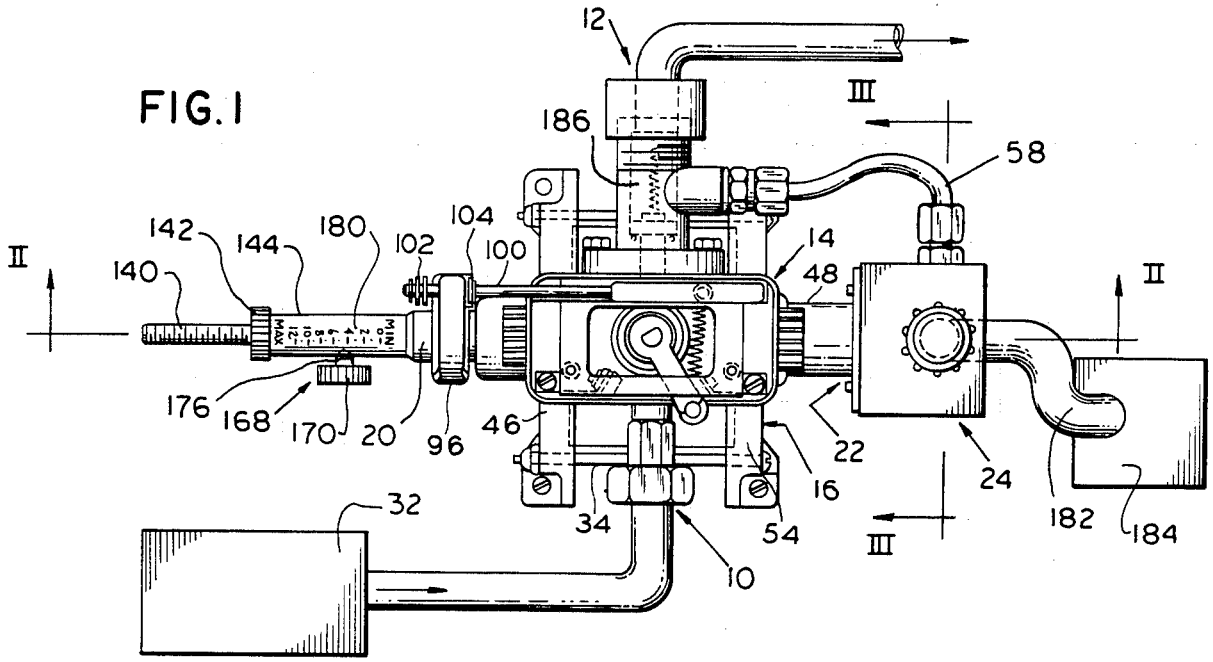
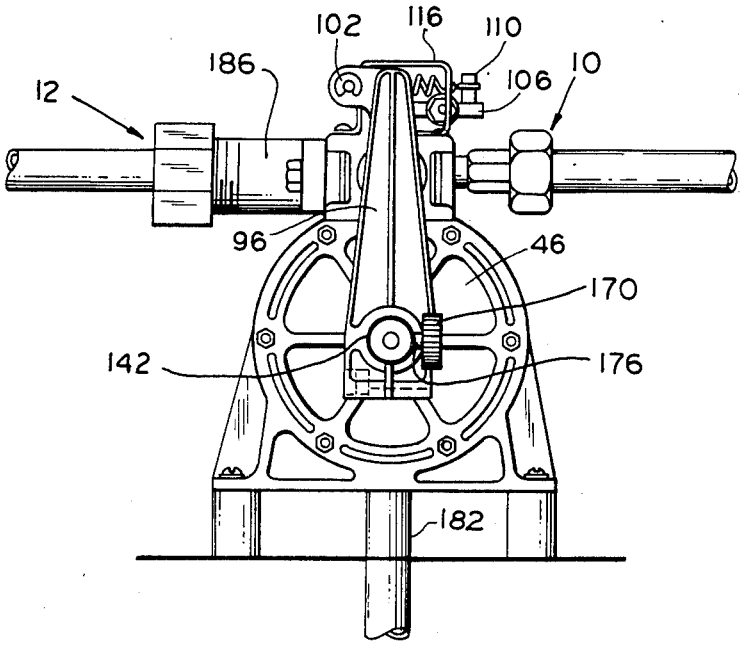
FIG. 5

FIG. 7
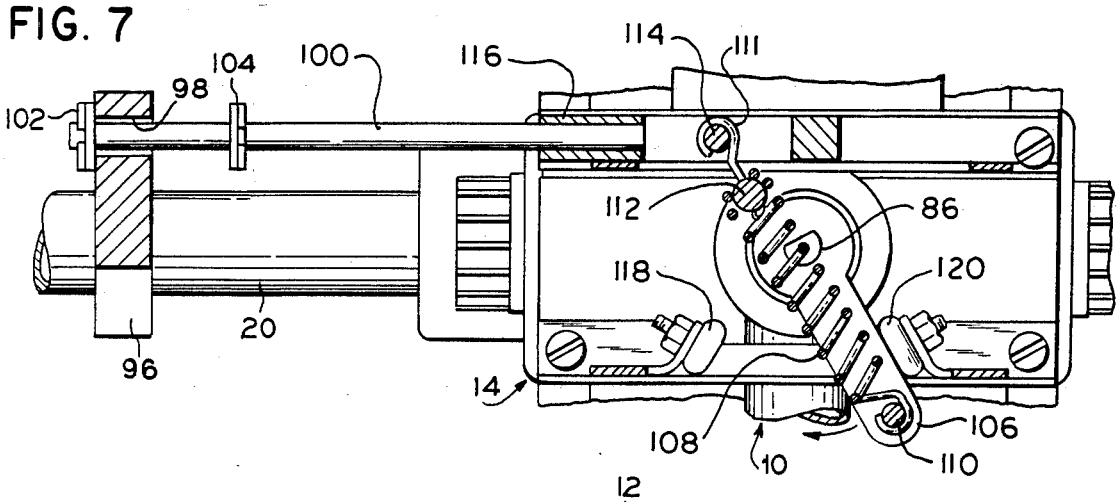
FIG. 8
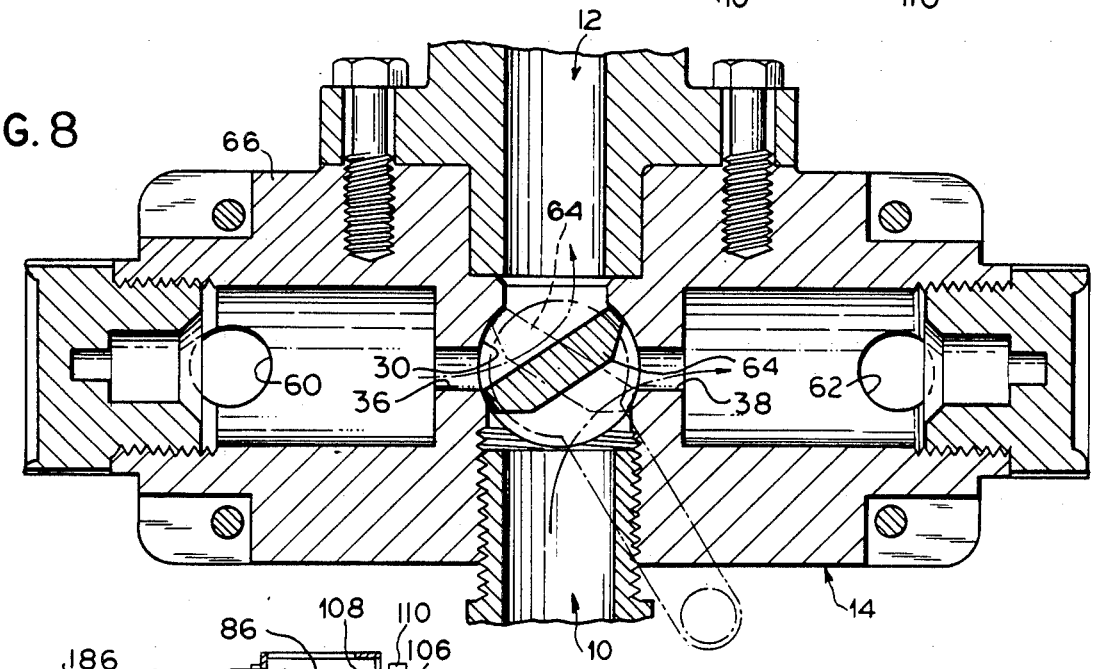
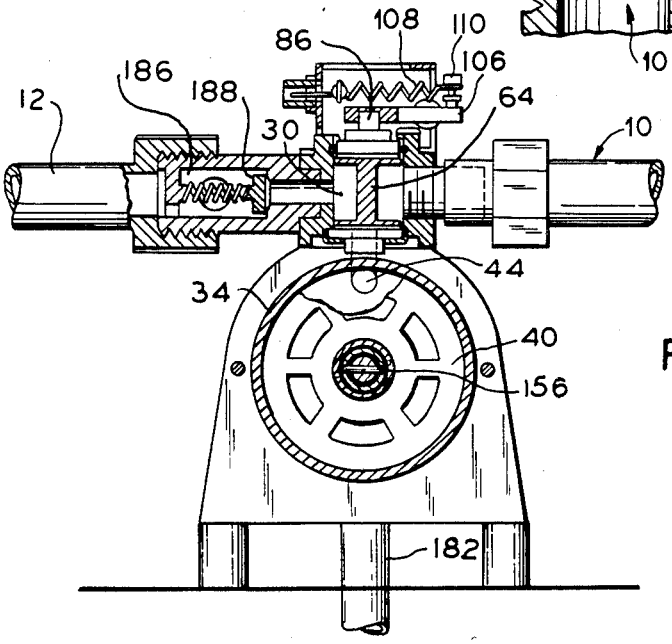
FIG. 4

VARIABLE PROPORTIONER

BACKGROUND OF THE INVENTION

1. Field of the Invention

This invention relates to improvements in a self-powered fluid proportioning apparatus of the variable type adapted for mixing a treating fluid with a raw fluid and discharging the fluids into a distribution means.

2. Description of the Prior Art

Many types of equipment have heretofore been proposed for feeding into a first fluid stream, such as water, a second fluid, including drugs, vaccines, nutrients, sanitizing, deodorizing, and softening materials and the like. Such prior systems, however, have been complicated in construction, unreliable in operation, cumbersome in use, not adapted for both portable and automatic continuous installation, have not been self-powered, nor variable. A variable proportioner device over which the present invention is an improvement is disclosed in several patents to Nat Cordis including U.S. Pat. Nos. 3,131,707; 3,114,379; 3,213,873; 3,213,796 and 3,291,066. Although the variable proportioner disclosed in those patents generally provided marginally acceptable performance, some drawbacks were present including stalling of the piston, breakage of the toggle lever spring, lack of precise adjustability of the metering piston, and erratic concentrate to water ratios.

The prior Cordis devices required that the slave pump piston be set so that there would be approximately 5/16 inches between the front face of the piston and the front pump head. As the pump operated, the spring associated with the piston would elongate, thus making the stroke longer. If enough space (5/16 inches) was not provided, the piston would stall against the pump head. However, by leaving this space, the slave pump piston was free to float forward, and did so especially under high line pressure and low demand. Thus, higher concentrations of chemicals would be injected into the stream under high line pressures than under low pressures. The friction of the piston seals was meant to prevent this floating, however, these seals also loosened over time. Thus, in the course of daily operation of the unit, some free floating occurred resulting in correspondingly different concentrate ratios depending on the line water pressure at the time.

SUMMARY OF THE INVENTION

The present invention provides improvement in the variable proportioners described above in which the drawbacks of the prior devices are overcome. The metering piston is now provided with an adjustment screw to provide for adjustability of the piston within the cylinder to allow for improved precision of the metering of the additive. A spring biased lost motion arrangement associated with the piston is provided to prevent either stalling of the piston against the cylinder front wall or free floating of the chemical piston resulting in excessive chemical discharge. Further, the toggle lever spring is improved and is constructed in two parts, pivotally connected, to reduce bending of the spring and the debilitating consequences of such bending action. In addition, the valve block gating system is constructed so that the maximum tolerance between the valve and the block is reduced to 0.00065 inches on each side, thus insuring against stalling resulting from valve bypass in situations of low water flow rates.

BRIEF DESCRIPTION OF THE DRAWINGS

FIG. 1 is a top plan view of a variable proportioner embodying the principles of the present invention.

FIG. 4 is a sectional view taken generally along the lines IV—IV of FIG. 1.

FIG. 5 is an end elevational view of the proportioner.

FIG. 7 is a partial top sectional view of the spring and toggle mechanism.

FIG. 8 is a top sectional view of the toggle valve mechanism.

DESCRIPTION OF THE PREFERRED EMBODIMENTS

Figure 3:
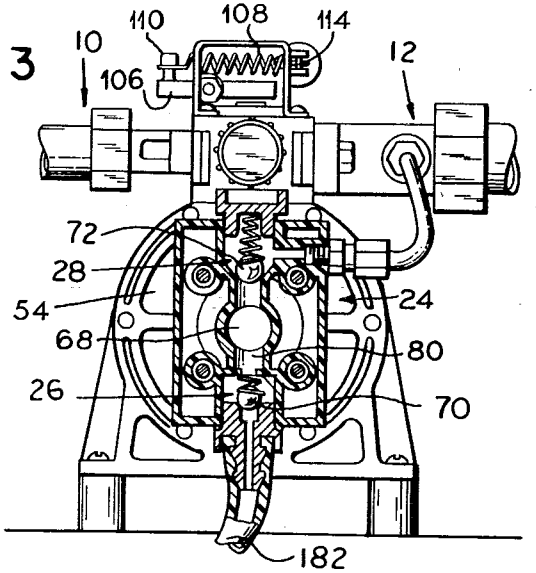
FIG. 3 is a sectional view of the additive valves taken generally along the lines III—III of FIG. 1.

Referring to the drawings, the apparatus illustrated includes a water inlet 10, a water outlet 12, a water gating assembly 14, a water motor 16, connecting rod 20, slave pump 22, and treating agent valve chamber means 24 having an inlet 26 and outlet 28.

Figure 2:
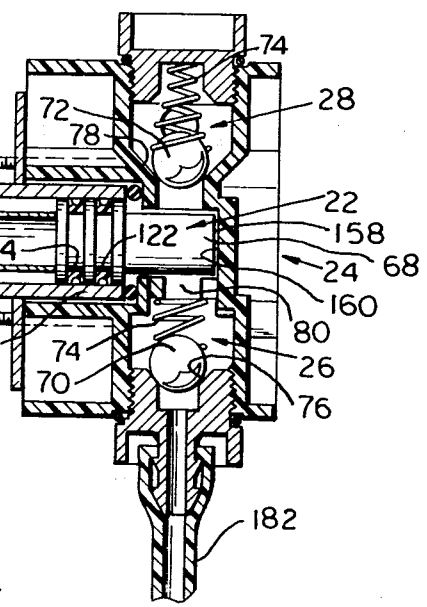
FIG. 2 is a side sectional view of the proportioner taken generally along the lines II—II of FIG. 1.
Figure 2:
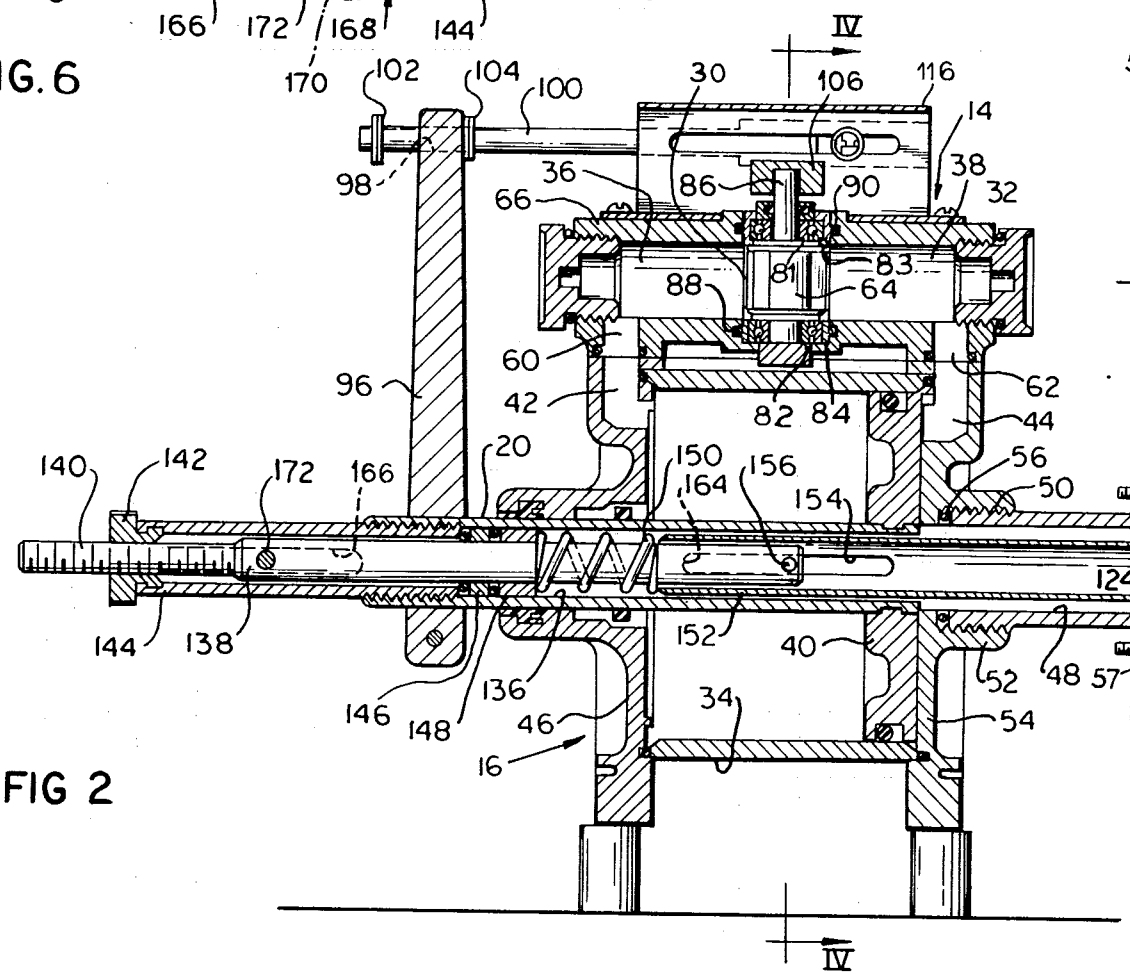
Figure 6:
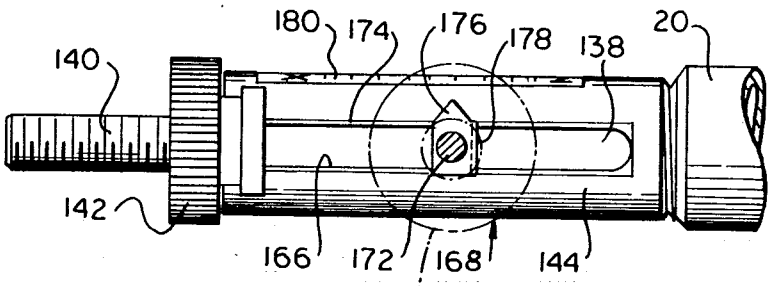
FIG. 6 is a partial side elevational view of the adjustment mechanism.

The water enters a valve chamber 30 in the water gating assembly 14 through line 10 from a water supply 32 and is gated into a motor body 34 alternately via port 36 or 38 to apply fluid pressure on opposite sides of a motor piston 40 via channel 42 or 44. The slave pump 22 comprises the connecting rod 20 carried by the piston 40, rod 20 passing through one end wall 46 of the motor body 34. A tubular pump cylinder 48 is mounted by a threaded end 50 engaging an internally threaded projection 52 in an opposite wall 54 of the motor body 34 and is provided with an O-ring gasket 56 between the threaded end 50 and the wall 54, as shown in FIG. 2.

The slave pump valve means 24 secured to a second end 57 of the pump cylinder 48 contains the inlet and outlet check valve assemblies 26 and 28, the inlet connection and outlet channel 58. The piston 40 is driven by the water entering the gating system 14, 36, 38, the water is expelled by the piston 40 alternately through channels 60 and 62, shunt valve 64 and a manifold valve block 66 and is discharged through outlet 12.

When the connecting rod 20 moves a plunger 68 away from the closed end of the pumping tube means 48, treating fluid is drawn into the treating agent valve assembly 24 through the "open" inlet check valve 26 and at the same time the suction produced by the withdrawal of the plunger 68 within the hollow pumping tube 48 closes the outlet check valve 28, which when subsequently opened discharges through the tube 58 and line 12.

When the direction of travel of the pumping plunger 68 is reversed in following the motion of the motor piston 40 through the rigid connecting rod 20, the inlet check valve 26 closes and the outlet check valve 28 opens so that the treating fluid trapped in the pumping tube 48 is ejected by plunger 68 under pressure into outlet conduit 12 in the manifold 66 via channel 58. The water and medication are discharged in a proportion based upon the displacement volume of the slave pump 22 and the volume of the motor chamber 34 on either side of the motor piston 40.

If desired, a multiplicity of check valve-pump assemblies may be provided and actuated by the water motor 16. In this way several types of treating agents or additives may be blended with the water at the same time.

The pumping valve block 24 houses the inlet check valve 26 and the outlet check valve 28. The inlet check valve 26 and the outlet check valve 28 comprise balls 70 and 72 held by springs 74 against valve seats 76 and 78. The delivery tube 58 communicates with the valve block 24 above the spring-loaded ball 72 and discharges into the line 12 as seen in FIG. 3.

The slave pump 22 includes the cylinder shaft 20 comprising the connecting rod for piston 40 with its axial bore and plunger 68. The treating fluid pumping tube 48 is tubular with an internal pumping channel terminating in chamber 80. On a suction stroke of the pumping plunger 68, the ball 70 of inlet check valve 26 lifts to open the port 76, and the ball 72 on the outlet check valve 28 closes the outlet port 78. When the pumping plunger 68 is on the ejection stroke, this situation is reversed so that the ball 72 is lifted and the ball 70 is seated.

The gating system 14 includes the valve plug 64, upper and lower bearings 81, 82 and bearing housings 83, 84 and a valve shaft 86 disposed within the valve chamber 30 in the valve block 66. These components are shown in detail by FIGS. 2, 4, 7 and 8 in the drawings. In FIG. 8, the valve block 66 is shown in cross-section and illustrates one of two alternate positions of plug 64 and flows through the channeled block 66. The valve gating assembly is machined so that the tolerance between the individual components are as follows: Between the bearings 81, 82 and the housing 83, 84, a 0.0005 inch press fit; between the bearing housing 83, 84 and the block 66, a 0.0001 to 0.0003 inch press fit; and between the valve 64 and valve block 66, 0.00065 inch maximium total per side. The valve block 66 is provided with O-rings 88 and 90 to effect a fluid-tight seal with the bearing housings 83, 84.

The valve plug 64 is shifted from two extreme positions, alternately closing and exposing the ports 36 and 38 leading to channels 60 and 62, respectively, which direct the flowing fluid to opposite sides of the motor piston 40. The maximum tolerances described above eliminate valve bypass and subsequent stalling at low water flow rates, but provide valve centering and smooth operation at high flow rates. If these tolerances are increased, the pump either jams or stalls at low water flow rates.

The connecting rod 20 projects through the end wall 46 and supports an actuating arm 96 which terminates at its upper end in a bore 98 through which a reversing rod 100 passes. A pair of C-rings 102 and 104 on the reversing rod 100 comprise travel stops contacted by the arm 96 for shuttling the reversing rod 100 between its positions.

The upper end of the valve shaft 86 is keyed to a toggle lever 106 for corotation therewith. The toggle lever 106 is actuated by a coil spring 108 anchored at one end to a post 110 carried by the free end of toggle lever 106 and is anchored at its other end by a hook 111, having a ball shaped end 112 captured on the spring 108, engaging a post 114 fixed to the shiftable reversing rod 100. The rod 100 is slidably carried within a guide 116 secured to the valve block 14. By using the hook 111 with the ball shaped end 112 to anchor the second end of the spring 108, the spring 108 is allowed to pivot on the ball 112 which reduces bending of the spring and associated weakening. Incorporation of this feature has substantially increased the useful life of spring 108, which in the prior devices was subject to considerable stress and had an expected operating life of only a few months.

When the actuating arm 96 contacts either of the stops 102 or 104, the movement of the actuating arm 96 is imparted to the reversing rod 100 which in turn shifts the spring anchor post 114 with the result that the spring 108 swings about the post 110 carried by the toggle lever 106 until there has been sufficient travel thereof to shift the toggle lever 106 by the action of the spring 108. When this occurs, the valve shaft 86 is rotated and moves the valve plug 64 to a different diverting position. The travel or throw of the free end of the toggle lever 106 is controlled and restricted by resilient pads 118 and 120 fixed to the valve block assembly 14.

As the piston 40 travels in the motor cylinder 34 the connecting rod 20 carries the actuating arm 96 with it causing the toggle lever 106 to pivot between the two positions determined by the pads 118 and 120. At the limits of travel of the reversing rod 100, the shunt valve 64 is placed in the alternate positions as shown in FIG. 8. This causes the water to course through the channels 60 or 62 leading to the opposite sides of the piston 40 thereby displacing the piston 40 to opposite ends of the motor cylinder 34 and actuating the slave pump 22 as described.

Referring to FIG. 2, seal rings 122 and 124, prevent passage of liquid between the motor body 34 and the slave pump chamber 80. The motor piston 40 within motor cylinder 34 has the tubular connecting rod 20 fixed to it and projects axially through end wall 46. The connecting rod 20 contains a bore 136 accommodating an adjustable shaft 138. The adjustable shaft 138 has a threaded end 140 which projects through a captured rotatable nut 142 in the end of a hollow extension tube 144 threadingly secured to an end of the connecting rod 20. A sealing block 146 abuts the threaded end of tube 144 and is in turn abutted by a stop block 148. A coil spring 150 is captured on the shaft 138 and abuts the stop block 148 at one end and a tube 152 carrying the piston head 68 and seals 122, 124 on the other end. The tube 152 has an elongated slot 154 therein which receives a projecting pin 156 on the shaft 138.

With this novel arrangement, the piston head 68 is always urged or biased to the farthest position into the slave pump chamber 80 in the pump block 24 when the motor piston 40 is moved to a position against end wall 54 such that a front face 158 of the piston head 68 abuts an inner surface 160 of the block front wall. This allows for as complete evacuation of the slave pump chamber 80 as is possible. The spring connection 150 between the piston head tube 152 and the connecting rod 20 prevents stalling of the piston head 68 against the front wall as sometimes occurred in prior devices and also prevents free floating of the piston head 68 thereby insuring consistant metering.

The spring 150 must be of sufficient strength so that it will not compress during the chemical discharge stroke, but rather will force the piston head face 158 against the inner surface 160 of the block front wall prior to compressing.

When the motor piston 40 reverses its movement and thus moves toward wall 46, the connecting rod 20 is likewise moved. The slave pump piston head 68 is held against the wall by action of spring 150, even though tension through the spring is decreasing, until the pin 156 engages an end 164 of the slot 154. At that point, as the connecting rod 20 continues its outward movement, the slave pump piston is likewise moved and causes the additive to be drawn into the slave pump chamber 80 through check valve 26 as described above.

By rotating captured nut 142, the relative position of the pin 156 in the slot 154 is changed. If the pin is moved toward end 164 of the slot 154, engagement will occur sooner during the outward movement of connecting rod 20 and a larger amount of additive will be drawn into the slave pump chamber 80. Conversely, if the pin is moved away from end 164 in the slot 154, less additive will be drawn into the slave pump chamber 80 during outward movement of the connecting rod 20.

The extension tube 144 has a slot 166 formed therein which exposes a portion of the shaft 138. A threaded hole is formed in the shaft 138 to receive a screw member 168 having an enlarged knurled head 170 and a threaded shank 172. A flat area 174 is milled adjacent the slot 166 to provide an abutment surface for a pointer member 176 which is carried on the shank 172 of screw member 168. A tab 178 connected to the pointer member 176 projects into the slot 166 to prevent rotation of the pointer member 176 on the shank 172. When the screw member 168 is securely tightened, the gripping action between the screw head 170, the pointer member 176 and the milled area 174 effectively prevents movement of the shaft 138 and prevents manual rotation of the captured nut 142. Thus, the screw member 168 acts as a lock to prevent movement of shaft 138.

An indicia scale 180 is provided on an outer surface of the tube 144 adjacent the pointer member 176. Thus, by loosening the locking screw member 168 the captured nut 142 can be rotated to move the shaft 138 relative to the extension tube 144 which will cause the pointer member 176 to move relative to the indicia scale 180. In this manner, the appropriate mixing ratio can be selected. Once the appropriate ratio has been selected, the locking screw member 168 can be tightened against the tube 144 to prevent accidental or unauthorized movement of the shaft 138.

In operation, an additive intake conduit 182 is connected to an additive container 184. Pressurized water from water source 132 is directed into the device through inlet 10 which causes alternating movement of piston head 40 as described above. As piston head 40 moves within the cylinder 34, it carries rod 20 and, through the spring 150, slot 154 and pin 156 arrangement, also slave piston head 68. As piston head 68 is withdrawn from the pumping chamber 80, additive is drawn up through open valve 26 into the slave pump chamber 80. Upon return movement of the motor piston 40, the slave plunger 68 returns all the way into pump chamber 80 until the front piston face 158 engages the inside wall 160 of the pump chamber. This causes the additive to pass through check valve 28 and out through discharge conduit 58 to mix with exiting water in a mixing chamber 186, best seen in FIG. 4, before entering discharge conduit 12. Within the mixing chamber 186 there is provided a spring biased check valve 188 which prevents reverse flow of diluted additive from entering the gating area 14. This exit check valve 188 provides consistancy and integrity of the mixing ratio.

As is apparent from the foregoing specification, the invention is susceptible of being embodied with various alterations and modifications which may differ particularly from those that have been described in the proceeding specification and description. It should be understood that we wish to embody within the scope of the patent warranted hereon all such modifications as reasonably and properly come within the scope of our contribution to the art.

We claim as our invention:

1. In a portable self-powered fluid proportioning device which comprises in combination:

a fluid supply conduit means, a movable motor piston means, a fluid gating means disposed intermediate said fluid supply and said piston means to cause reciprocating movement of said motor piston means, a connecting rod means secured to said piston means for movement therewith, and a slave pump piston connected to said connecting rod for providing responsive reciprocatory movement of said slave pump piston within a pump cylinder, the improvement comprising:

a spring biased lost motion connection, wherein said lost motion connection comprises a slot and pin arrangement, between said connecting rod and said slave pump piston in which said slave pump piston is continuously biased toward an end wall of said pump cylinder and is selectively movable away from said end wall by action of an adjustable connection between said connecting rod and said slave pump piston which permits an adjustable amount of movement of said connecting rod prior to effecting movement of said slave pump piston.

2. The device of claim 1 wherein said slave pump piston is biased against said end wall of said cylinder until moved away by said connecting rod.

3. The device of claim 1 wherein said pin is associated with and moves in concert with said connecting rod and said slot is formed in said slave pump piston.

4. The device of claim 1 wherein said adjustable connection comprises a threaded connection providing continuous adjustability throughout a range of possible settings.

5. The device of claim 1 wherein indicia markings and a pointer are associated with said adjustable connection to provide an indication of the position of said adjustable connection.

6. The device of claim 1 wherein locking means are provided to selectively lock said adjustable connection against movement.

7. In a portable self-powered fluid proportioning device which comprises in combination:

a fluid supply conduit means, a movable motor piston means, a fluid gating means disposed intermediate said fluid supply and said piston means to cause reciprocating movement of said motor piston means, a connecting rod means secured to said piston means for movement therewith, and a slave pump piston connected to said connecting rod for providing responsive reciprocatory movement of said slave pump piston within a pump cylinder, the improvement comprising:

means for biasing said slave pump piston toward an end wall of said pump cylinder, a selectively adjustable connection means between said slave pump piston and said connecting rod comprising, a continuously adjustable pin member captured in a slot means in said slave pump piston, whereby axial adjustment of said connection means allows selected movement of said connecting rod prior to effecting movement of said slave pump piston away from said cylinder end wall.

8. The device of claim 7 wherein said slave pump piston is biased against said end wall of said cylinder until moved away by said connecting rod.

9. The device of claim 7 wherein said biasing means comprises a spring connection between said connecting rod and said slave pump piston.

10. The device of claim 7 wherein said adjustable connection comprises a threaded connection providing continuous adjustability throughout a range of possible settings.

11. In a portable self-powered fluid proportioning device which comprises in combination:

a fluid supply conduit means, a movable motor piston means, a fluid gating means including a spring biased toggle lever disposed intermediate said fluid supply and said piston means to cause reciprocating movement of said motor piston means, a connecting rod means secured to said piston means for movement therewith, and a slave pump piston connected to said connecting rod for providing responsive reciprocatory movement of said slave pump piston within a pump cylinder, the improvement comprising:

a spring biased lost motion connection comprising a slot and pin arrangement between said connecting rod and said slave pump piston in which said slave pump piston is continuously biased toward an end wall of said pump cylinder and is selectively movable away from said end wall by action of an adjustable connection between said connecting rod and said slave pump piston which permits an adjustable amount of movement of said connecting rod prior to effecting movement of said slave pump piston, and said spring biasing said toggle lever comprising a coil spring having a pivotable connection at one end comprising a ball member captured by the coils of said spring.

* * * * *